US005472328A

United States Patent [19]

Saito et al.

[11] Patent Number: 5,472,328

[45] Date of Patent: Dec. 5, 1995

[54] SCROLL TYPE COMPRESSOR HAVING AN OIL SEAL BEARING FOR THE DRIVE SHAFT

[75] Inventors: Susumu Saito; Nobukazu Takagi; Kiyohiro Harada; Yukio Kazahaya; Seiji Kuchiki; Masakuni Ishikawa; Nobuyuki Nakajima, all of Konan, Japan

[73] Assignee: Zexel Corporation, Tokyo, Japan

[21] Appl. No.: 284,991

[22] Filed: Aug. 4, 1994

[30] Foreign Application Priority Data

Aug. 5, 1993 [JP] Japan ..... 5-213374
Feb. 17, 1994 [JP] Japan ..... 6-043152

[51] Int. Cl.[6] ..... F04C 18/04; F04C 27/00; F04C 29/02

[52] U.S. Cl. ..... 418/55.4; 418/55.6; 418/88; 418/94

[58] Field of Search ..... 418/55.6, 88, 94, 418/55.4

[56] References Cited

FOREIGN PATENT DOCUMENTS 1301972 12/1989 Japan ..... 418/55.6
3-61689 3/1991 Japan .
3-105093 5/1991 Japan .
3-149391 6/1991 Japan .
4-47185 2/1992 Japan ..... 418/55.6

*Primary Examiner*—John J. Vrablik
*Attorney, Agent, or Firm*—Wenderoth, Lind & Ponack

[57] ABSTRACT

In order to provide a simple structure to achieve sufficient lubrication and sealing in the various areas of a scroll compressor where sliding contact occurs, a spiral groove that communicates between a high-pressure side space and an area at an upper portion of a main bearing is formed on the external circumferential surface of the drive shaft where it comes in contact with and slides against the main bearing. A seal bearing is provided in a drive shaft-receiving block between the high-pressure side space and a low pressure side space to seal off the high-pressure side space from the low pressure side space. An oil supply hole is provided that communicates between the high-pressure side space and an oscillation space which is formed by an oscillating scroll member and an oscillating shaft. With this, a first oil passage that lubricates the main bearing and a second oil passage that lubricates an oscillating shaft-insertion hole are formed. A seal washer, the surface of which is polished to a specific roughness, is provided between the seal bearing and the drive shaft and, in addition, an elastic member is provided between the seal bearing and the block.

15 Claims, 7 Drawing Sheets

SCROLL TYPE COMPRESSOR HAVING AN OIL SEAL BEARING FOR THE DRIVE SHAFT

BACKGROUND OF THE INVENTION

1. Field of the Invention

The present invention relates to a scroll type compressor which is a coolant compressor used in a freezer or air conditioner and is provided with a coil-like fixed scroll and an oscillating scroll that interlocks with the fixed scroll to form a compression space in which the volumetric capacity of the compression space is varied with the oscillating motion of the oscillating scroll to compress the coolant.

2. Description of the Related Art

A scroll type compressor of the prior art is provided with a drive shaft that is rotated by a means for driving such as an electric motor, an oscillating scroll member which is mounted eccentrically on the drive shaft and a fixed scroll member that interlocks with the oscillating scroll member to form a compression space (scroll chamber). The volumetric capacity of the scroll chamber is varied by oscillating the oscillating scroll member relative to the fixed scroll member to take in, compress and discharge the coolant. Thus, the lubrication and sealing of the various sliding contact surfaces of the scroll type compressor are crucial factors.

Accordingly, the scroll type compressor disclosed in Japanese Patent Unexamined Publication No. H3-149391 includes a rotary displacement type oil pump in its structure, so that a sufficient quantity of lubricating oil can be reliably supplied to the bearings regardless of the flow rate of the lubricating oil supplied to the compression work space. With this, a large quantity of lubricating oil can be assured against high loads applied to the sliding contact surface of the oscillating scroll member, the drive shaft and the main bearing provided in the area where the drive shaft slides against the block that secures the fixed scroll member, the thrust bearing provided in the area where the scroll member slides against the block and the like.

Also, the scroll type compressor disclosed in Japanese Patent Unexamined Publication No. H3-61689 is provided with a cylinder section in the direction of the reciprocal movement of the oldham's coupling, which prevents auto rotation of the oscillating scroll member, on the wall surface facing opposite the external circumferential surface of the oldham's coupling. A liner is provided that moves back and forth within the cylinder in conformance with the operation of the oldham's coupling to push out the lubricating oil. This structure allows the quantity of supplied oil to be increased as the number of rotations of the drive unit increases.

Likewise, Japanese Patent Unexamined Publication No. H3-105093 discloses a scroll-type compressor in which a pressurized passage, which is subject to centrifugal force from the drive shaft, is formed in the drive shaft running towards the outside in the direction of the radius of the drive shaft, constituting a so-called centrifugal pump to supply lubricating oil.

However, with the scroll type compressors in the examples cited above, if a non-ferrite material, such as an aluminum alloy is used for the fixed scroll member and the oscillating scroll member in order to reduce weight and cost, the following problem arises since the back pressure applied to the oscillating scroll member is high, the force that is applied to the oscillating scroll member toward the fixed scroll member results in seizure of the sliding area where the oscillating scroll member and fixed scroll member are in contact with each other.

SUMMARY OF THE INVENTION

The object of the present invention is to provide a scroll type compressor with a simple structure that assures sufficient lubrication and sealing of the various sliding contact areas.

In order to achieve this object, the present invention is a scroll type compressor that comprises: a drive unit that is provided in a high pressure space within a sealed case, an oscillating scroll member that oscillates with the rotation of the drive shaft, an oscillating shaft which is formed as an eccentric extension of the drive shaft in the drive unit, an insertion hole in which the oscillating shaft is mounted, a block that is secured within the sealed case and which is provided with a through hole that accommodates the main bearing, which, in turn, holds the drive shaft in such a manner that it can rotate freely, and a fixed scroll member that contains the oscillating scroll between itself and the block in such a manner that the oscillating scroll member can oscillate freely. The scroll compressor is further provided with an oil reservoir formed within a high pressure side space for storing the lubricating oil, an oil space defined by the end of the drive shaft and the block, a seal bearing that seals off the oil space from a low pressure side space formed by the oscillating scroll member and the block, at least one spiral groove which is formed on the external circumferential side surface of the drive shaft, with one end opening into the high-pressure side space and the other end rising up toward the upper end of the main bearing at a specific angle, and an oil supply hole that communicates between the high-pressure side space and a bottom space which is formed at the end of the oscillating shaft.

With this structure, in which at least one spiral groove is formed on the external circumferential surface of the drive shaft in the area where the main bearing is in sliding contact with the drive shaft, a seal bearing is provided between the drive shaft and the block for sealing off the high-pressure side space from the low pressure side space and an oil supply hole which communicates between the high-pressure side space and the bottom space. A first oil passage, whereby oil passes through the spiral groove which functions as a pump to lubricate the main bearing. A second oil passage is provided whereby, due to the difference in pressure between the high-pressure side space and the low pressure side space, oil passes through the oil supply hole, the bottom space, the insertion hole, the low pressure and the insertion hole are formed. As a result, lubricating oil can be separately supplied to the main bearing and the insertion hole, thereby achieving efficient lubrication.

The present invention is also provided between the seal bearing and the drive shaft with a seal washer which is polished to a specific surface roughness.

With the seal washer provided between the seal bearing and the drive shaft, the polishing process at the time of forming the drive shaft and the seal bearing can be simplified. Additionally, the seal bearing service life is increased. Consequently, the seal between the high-pressure side space and the low pressure side space can be maintained for a longer time.

The present invention is also provided with an elastic member between the seal bearing and the block.

By providing the elastic member between the seal bearing and the block, leakage which would otherwise develop between the drive shaft and the seal bearing caused by the torsion of the drive shaft, which is in turn caused by the force applied to the oscillating scroll member, can be prevented. As a result, the pressure differential between the high-pressure side space and the low pressure side space can be maintained, thereby achieving reliable lubrication.

Another object of the present invention is to provide a seal bearing for a scroll type compressor that can receive the force applied to the drive shaft efficiently, which seals off the high pressure side from the low pressure side and which can be manufactured at a low cost and with high efficiency by press machining.

In order to achieve this object, the present invention is a scroll type compressor that comprises: a driving means provided in a high pressure space within a sealed case, a drive shaft which extends out from the driving means, an oscillating shaft which is formed as an eccentric extension of one end of the drive shaft and oscillates with the rotation of the drive shaft, an oscillating scroll member provided with an insertion hole into which the oscillating shaft is mounted, a block secured within the sealed case and which is provided with a through hole that accommodates a main bearing, which holds the drive shaft in such a manner that it can rotate freely, a fixed scroll member that is secured to the block and which forms a compression space by interlocking with the oscillating scroll member, and a lubricating oil reservoir formed within the high pressure space. The scroll compressor is further provided with a seal bearing between the end of the drive shaft and the block. The seal bearing has a circular groove formed by press machining and located on the side surface that is adjacent to the end of the drive shaft at the junction with the oscillating shaft for supplying lubricating oil from the lubricating oil reservoir. Press escapes are located on the other side surface of the seal bearing that is not in contact with the block.

In summary, in the present invention, the seal bearing, which is positioned between the end of the drive shaft and the block, is provided with a groove formed by press machining on one of the side surfaces of the seal bearing where it lies adjacent to the end of the drive shaft. In this instance, by forming press escapes on the other side surface in an area that does not slide against the block, protrusions which may otherwise occur on the side of the groove can be prevented, thereby facilitating the formation of the sliding surface and mass production. Also, as protrusions on the sliding surface can be prevented, the high pressure lubricating oil supplied to this groove is prevented from leaking out. Consequently, a force can be maintained in the opposite direction to the force applied to the drive shaft.

BRIEF DESCRIPTION OF THE DRAWINGS

The above and other objects, features and advantages of the present invention will be apparent from the following detailed description of the preferred embodiments of the invention in conjunction with the accompanying drawings in which.

DETAILED DESCRIPTION OF THE PREFERRED EMBODIMENTS

The following is an explanation of the preferred embodiments in reference to the drawings.

Figure 1:
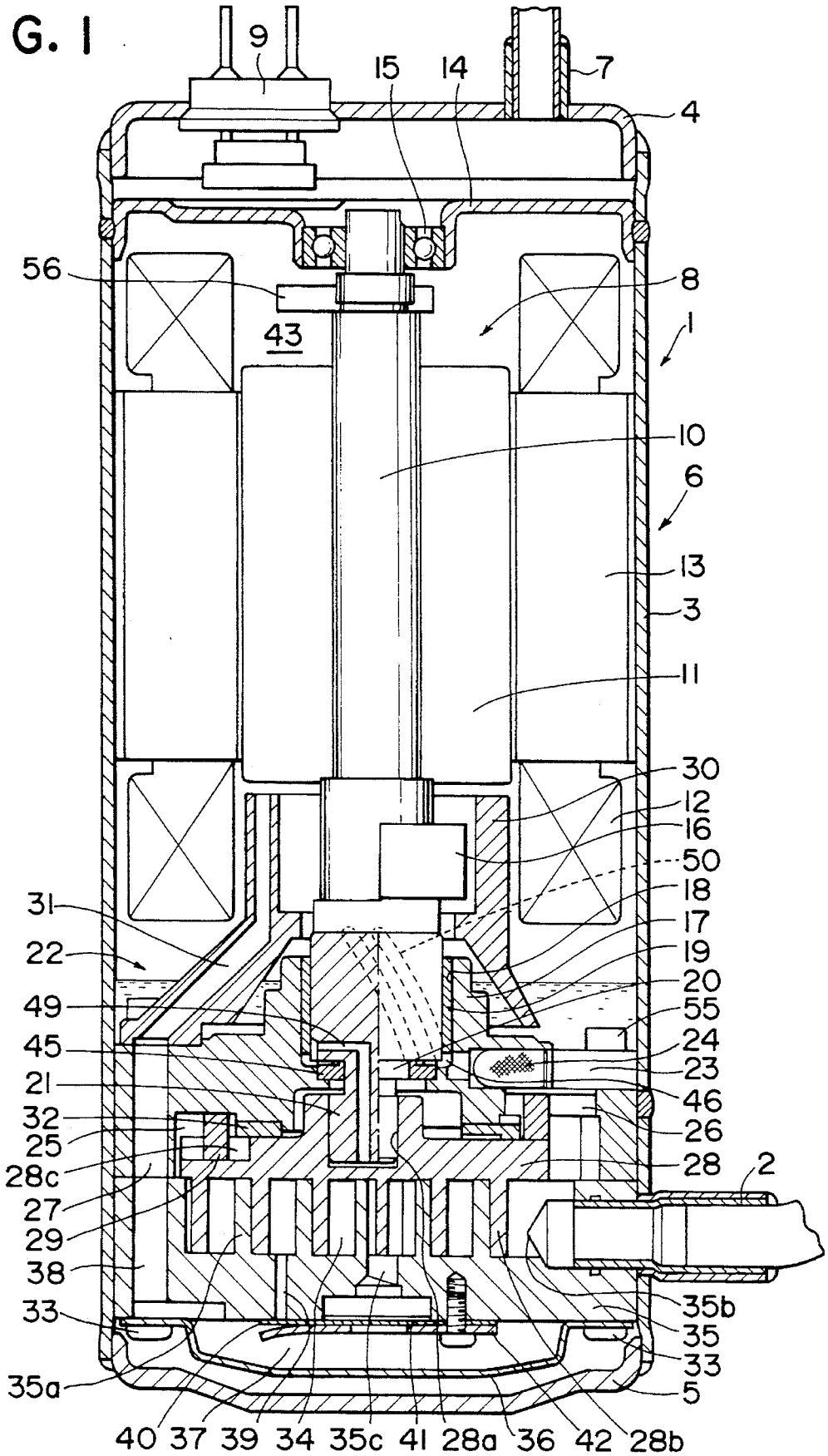
FIG. 1 is a cross section of a scroll type compressor in an embodiment according to the present invention.

In the scroll type compressor 1 shown in FIG. 1, a sealed case 6 is structured with a cylindrical member 3 that is provided with a coolant intake port 2, a cap member 4 that seals the upper end of the cylindrical member 3, and a base member 5 that seals the lower end of the cylindrical member 3. Note that the cap member 4 is provided with a coolant outlet port 7 and a power supply terminal 9 for an electric motor 8.

The electric motor 8 may be, for example, a DC brushless motor provided with a drive shaft 10, a rotor 11, which is secured onto the drive shaft 10 and which is surrounded by a permanent magnet and a stator 13, which is secured onto the internal circumferential surface of the cylindrical member 3 and is wrapped by a coil winding 12.

The upper portion of the drive shaft 10 is held by the drive shaft holding member 14 via the bearing 15 in such a manner that it can rotate freely. A balance weight 16 is secured onto the lower portion of the rotor 11 and a sub balance weight 56 is secured onto the upper portion of the rotor 11. Additionally the lower portion of the drive shaft 10 is held in the through hole 18 formed in the block 17, which is to be explained later, via the main bearing 19 in such a manner that it can rotate freely. Also, at the lower end of the drive shaft 10, the oscillating shaft 21 is provided as an eccentric extension of the drive shaft 10 via the bearing mounting section 20.

The block 17 is secured to the internal circumferential surface of the cylindrical member 3 by, for example, spot welding or the like, and is provided with the through hole 18 formed by piercing the center, and an oil hole 23 which opens into an oil reservoir 22, which is to be explained later, and on which a filter 24 is mounted. An oldham's-ring housing chamber 25 is formed on the surface of the block 17 where an oscillating scroll member 28 slides, to contain the oldham's ring 29 that will be explained later, and which prevents the oscillating scroll member 28 from rotating. In addition, an oldham's ring groove 26 is formed, in which a tab portion of the oldham's ring 29 is inserted in such a manner that it can slide freely. A thrust bearing 32, which is shown as a scroll bearing 32 in FIG. 3, with a lubricating oil groove having an appropriate constriction formed in it, is also provided on this sliding surface.

On the upper section of the block 17, a cover 30 is provided in such a manner that it surrounds the rotating range of the balance weight 16 mounted on the drive shaft 10 and the oil reservoir 22 is formed around the cover 30 over the block 17. Note that a coolant outlet channel 31 is formed in the cover 30 and communicates with the coolant passage 27 that is formed in the block 17.

The oscillating scroll member 28 is provided with the insertion hole 28*a* into which the oscillating shaft 21, which is an eccentric extension of the drive shaft 10 via the bearing mounting section 20, is inserted in such a manner that it can rotate freely, and an oscillating scroll 28*b* formed in a coil shape is provided on the opposite surface from the surface where the insertion hole 28*a* is formed. Note that an oldham's ring groove 28*c* is formed on the surface where the insertion hole 28*a* is formed.

The fixed scroll member 35 is provided with a fixed scroll 35*a* that forms a compression space 34 by interlocking with the oscillating scroll 28*b* on the upper surface of the oscillating scroll member 28 in such a manner that the oscillating scroll member 28 can oscillate freely and the fixed scroll member 35 is secured to the block 17 with the bolt 55. On the side portion of the fixed scroll member 35, an intake chamber 35*b* that communicates with the coolant intake port 2 is provided and an outlet hole 35*c* is formed at the center. This outlet hole 35*c* communicates with an outlet space 37 which is formed by a cover 36 that covers the lower side surface of the fixed scroll member 35, and an outlet passage 38 is provided that communicates between the outlet space and a coolant passage 27 formed in the block 17. The cover 36 is secured to the fixed scroll member 35 with bolts 33. Also, a bypass passage 39 that communicates between the middle portion of the compression space 34 and the outlet space 37 is formed and this bypass passage 39 is opened and closed with a relief valve 40. Additionally, a check valve 41 is provided at the outlet hole 35*c* and this check valve 41 is held within the outlet hole 35*c* with a check valve holder 42.

When the electric motor 8 is driven in a scroll type compressor 1 structured as described above, the oscillating scroll member 28 eccentrically secured to the drive shaft 10 of the electric motor 8, makes an oscillating motion relative to the fixed scroll member 35 and the volumetric capacity of the compression space 34, constituted by the oscillating scroll 28*b* and the fixed scroll 35*a*, changes, thereby performing intake, compression and discharge in sequence. With this, the coolant is drawn in through the coolant intake port 2, enters via the intake outlet 35*b*, is compressed in the compression space 34 and travels from the outlet hole 35*c* through the outlet space 37, the outlet passage 38, the coolant passage 27 and the coolant outlet channel 31 to reach a high pressure space 43. It is then discharged via the coolant outlet port 7 to the next process in the cooling cycle.

Figure 2:
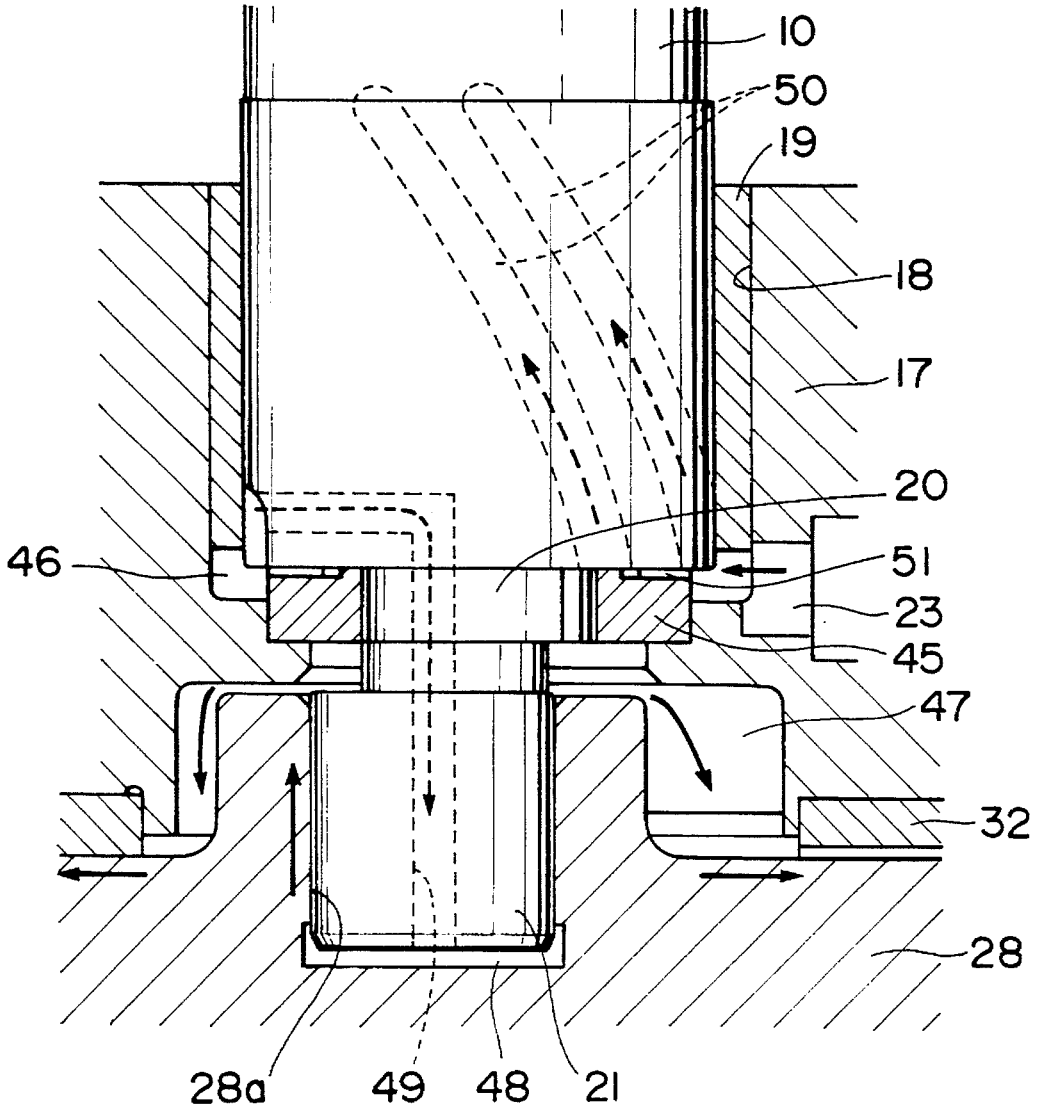
FIG. 2 is a partial enlarged cross section of the embodiment of FIG. 1 according to the present invention.

Additionally, as shown in FIG. 2, this scroll type compressor is provided with a seal bearing 45 mounted on the external circumferential portion of the bearing mounting section 20 between the lower end of the drive shaft 10 and the block 17. With this, a high-pressure side space 46 is formed, contained by the block 17, the drive shaft 10, the main bearing 19 and the seal bearing 45. Also, a low pressure side space 47 is formed, contained by the oscillating scroll member 28, the block 17 and the seal bearing 45.

Figure 5:
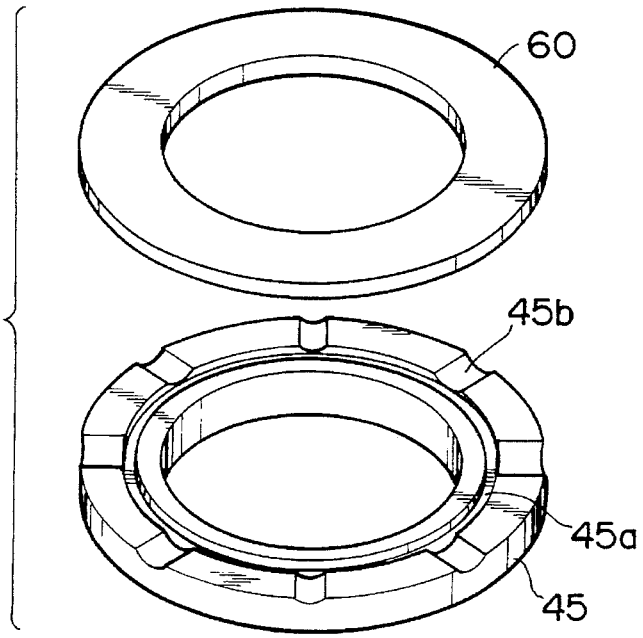
FIG. 5 is a perspective view of a seal bearing and a seal washer of the FIG. 4 embodiment.

This seal bearing 45 may be formed, for example, from a sintered alloy. A circular groove 45*a* and a plurality of radial grooves 45*b* which run radially from the circular groove 45*a* are formed on the side surface that comes in contact with the drive shaft 10, as shown in FIG. 5. High-pressure lubricating oil is supplied to the circular groove 45*a* and the radial grooves 45*b* to apply an upward force to the drive shaft 10 and consequently to reduce the downward load applied to the drive shaft 10.

Also, with the oscillating shaft 21 inserted in the insertion hole 28*a*, a bottom space 48 is formed below the insertion hole 28*a* and an oil supply hole 49 that communicates between the bottom space 48 and the high-pressure side space 46 is formed in the drive shaft 10 and the oscillating shaft 21.

Figure 3:
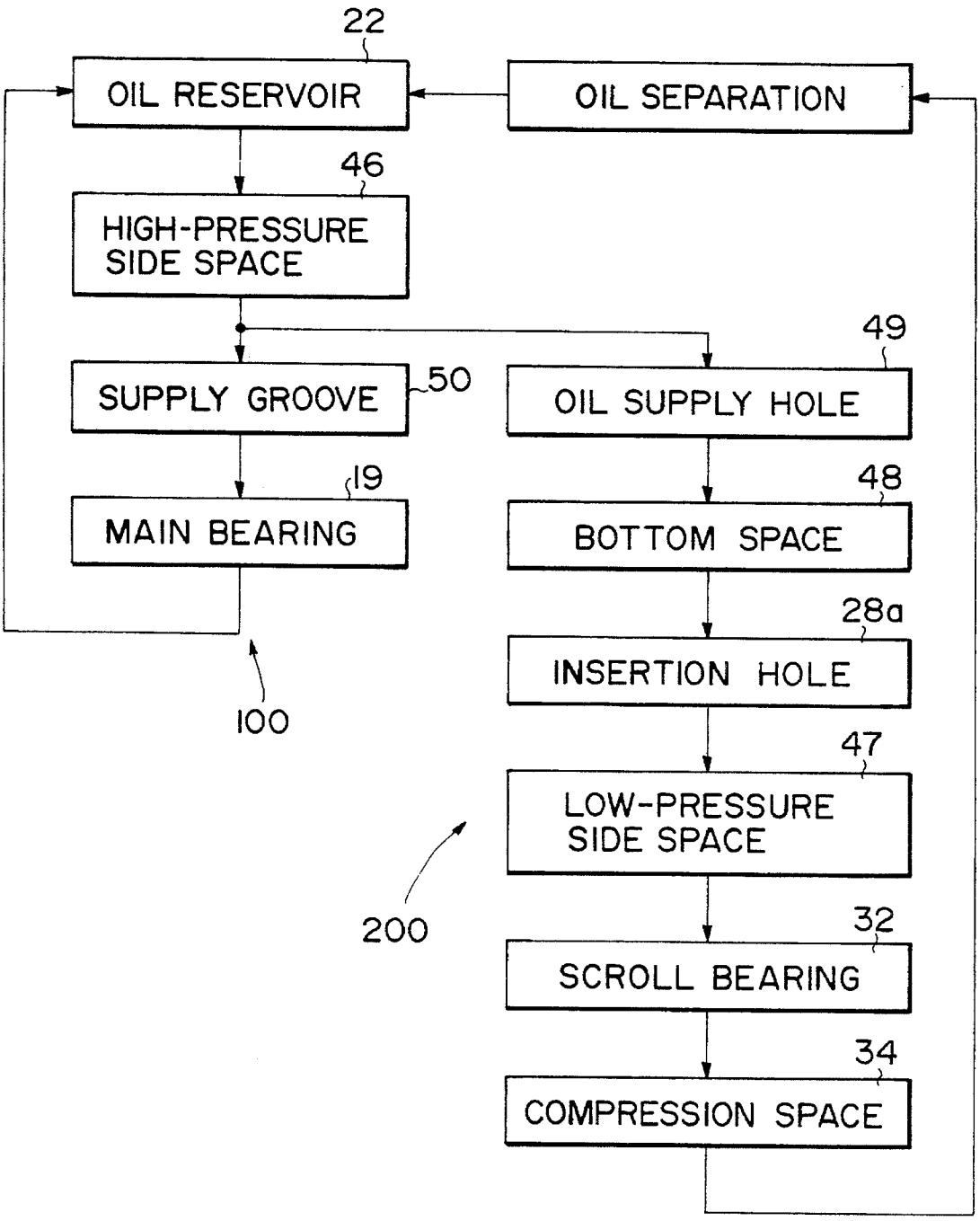
FIG. 3 is an explanatory chart of the oil passages.

In addition, at least one spiral groove 50 (two in this embodiment), which is shown as a supply groove 50 in FIG. 3, is formed on the contact surface of the drive shaft 10 where it slides against the main bearing 19. The supply grooves 50 are provided on the external circumferential side surface of the drive shaft 10 on the contact surface where the drive shaft 10 slides against the main bearing 19. A first end of each supply groove 50 opens into the high-pressure side space 46 and the grooves 50 are formed at a specific angle of inclination toward a second end that opens over the main bearing 19 along the external circumferential surface of the drive shaft. The second end is disposed rearwardly from (and thus lags) the first end in the direction of the rotation of the drive shaft.

In the structure described above, lubricating oil that has traveled from the oil reservoir 22 to the high-pressure side space 46, then, as shown in FIG. 3, is taken in from one end of the supply groove 50 that opens into the high-pressure side space 46 due to the rotating motion of the drive shaft 10, travels upwards along the supply groove 50, continues from the other end of the supply groove 50 that opens over the main bearing 19 through a first oil passage 100 that returns to the oil reservoir 22 and then travels through the oil supply hole 49, the bottom space 48, the insertion hole 28*a*, the low pressure side space 47, and on to the thrust bearing 32. The oil then travels through the intake chamber 35*b*, the compression space 34, the outlet hole 35*c* to the various passages 38, 27, 31 due to the pressure differential between the high-pressure side space 46 and the intake chamber 35*b* to reach, finally, the high pressure chamber 43 where it is separated from the high pressure coolant with the stirring of the rotor 11. Then it flows through the second oil passage 200 that returns to the oil reservoir 22. In summary, therefore, the main bearing 19 is lubricated via the first oil passage 100, and the insertion hole 28*a* and the thrust bearing 32 are lubricated and the compression space 34 is lubricated and sealed via the second oil passage 200.

With this, the main bearing 19 is lubricated separately from the insertion hole 28*a* and the thrust bearing 32. This arrangement prevents the insertion hole 28*a* and the thrust bearing 32 from being lubricated by lubricating oil that has become heated after lubricating the main bearing 19. This improves the durability of the oil and at the same time, assures sufficient lubrication of the insertion hole 28*a* and thrust bearing 32.

Figure 4:
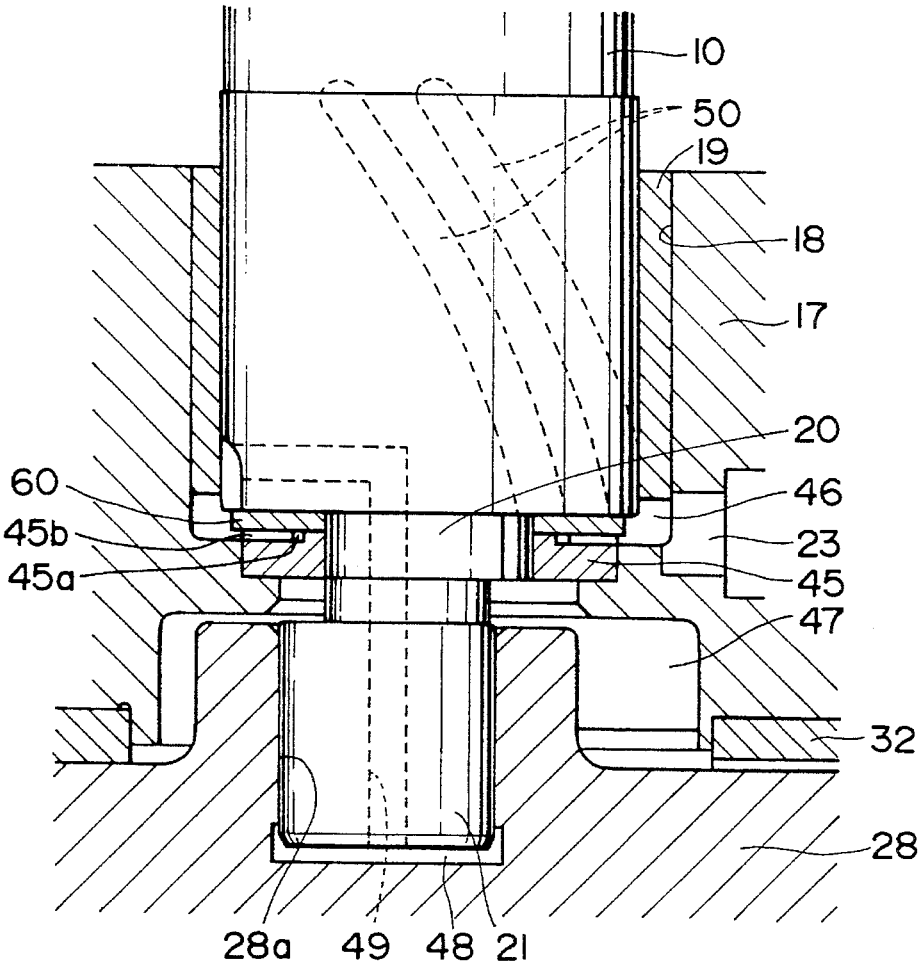
FIG. 4 is a partial enlarged cross section of another embodiment according to the present invention.

The scroll type compressor according to the present invention is also provided with the seal washer 60 whose surface is polished to a specific roughness between the drive shaft 10 and the seal bearing 45 as shown in FIGS. 4 and 5. Although in the prior art the seal bearing 45 and the portion of the drive shaft 10 where it comes in contact with the seal bearing 45 are polished to a specific roughness, with the seal washer 60 thus provided, only this seal washer 60 needs to be polished to a specific roughness, thereby simplifying the work process and, at the same time, assuring smooth sliding at all times by simply replacing the seal washer 60.

Figure 6:
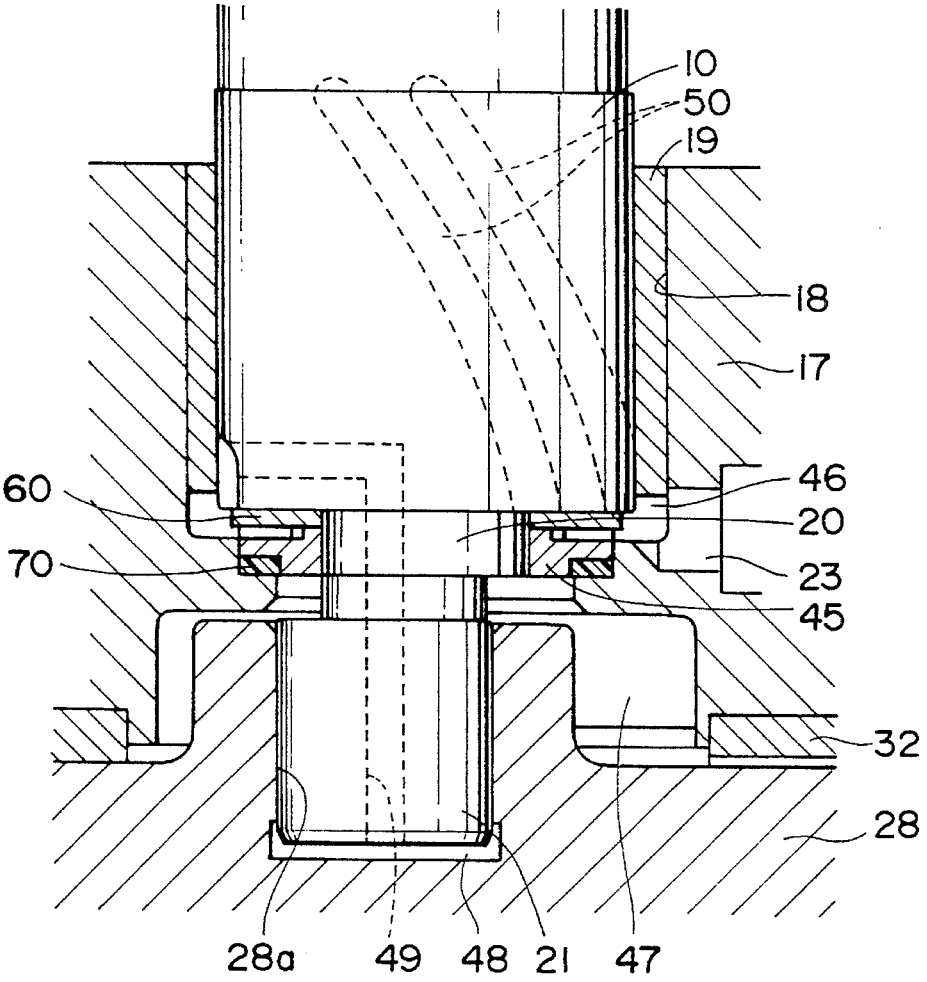
FIG. 6 is a partial enlarged cross section of yet another embodiment according to the present invention.
Figure 7:
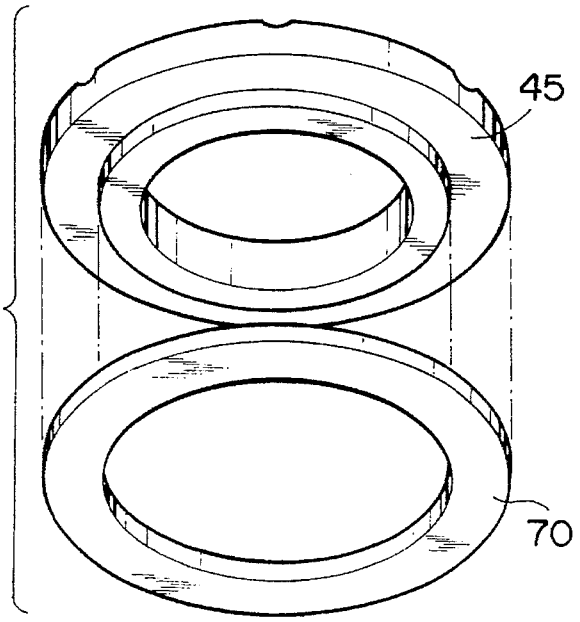
FIG. 7 is a perspective view of a seal bearing and an elastic member of the FIG. 6 embodiment according to the present invention.
Figure 8A:
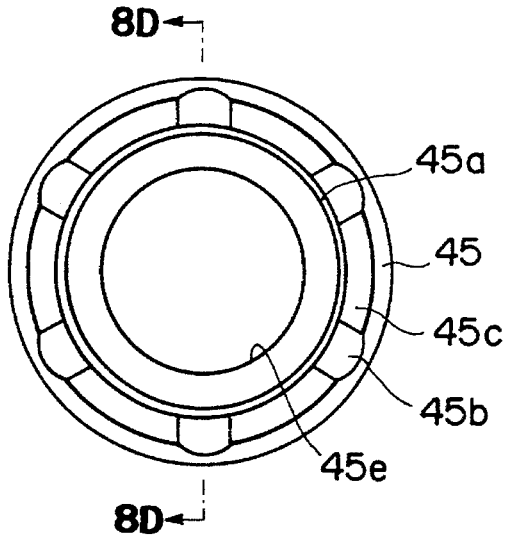
FIG. 8A is a plan view of the seal bearing.
Figure 8B:
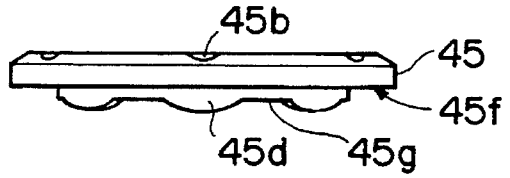
FIG. 8B is a side view of the seal bearing.
Figure 8C:
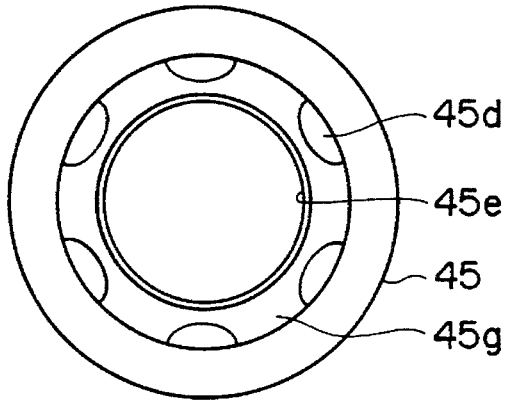
FIG. 8C is a bottom view of the seal bearing and FIG. 8D is a cross section of the seal bearing along line 8D—8D.
Figure 8D:
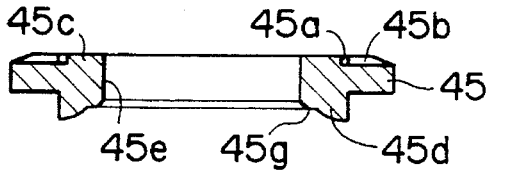

Furthermore, the scroll type compressor according to the present invention is also provided with an elastic member 70 which has a ring-like form and is constituted of rubber, resin or the like, between the seal bearing 45 and the block 17 as shown in FIGS. 6 and 7. This allows the inclination of the drive shaft 10, which is caused by the force applied to the drive shaft 10 by the oscillating scroll member 28, to be absorbed by the elastic member 70. Consequently, any reduction in the pressure differential between the high-pressure side space 46 and the low pressure side space 47 which would result from lubricating oil leaking through a minute gap which would otherwise occur in the area where the seal bearing 45 and the drive shaft 10 are in contact when the drive shaft 10 becomes inclined, is prevented. Thus, the pressure differential between the upstream side and the downstream side of the second oil passage 200 can be maintained, assuring that an appropriate quantity of lubricating oil passes through the second oil passage.

Although in this scroll type compressor the gap that would otherwise occur between the seal bearing 45 and the block 17 is prevented by the elastic member 70 absorbing the inclination of the drive shaft 10, it is also possible to form the area of contact between the seal bearing 45 and the block 17 spherically to correspond with the inclination of the drive shaft 10 in order to prevent a gap from occurring between the seal bearing 45 and the block 17 caused by the inclination of the drive shaft 10.

As has been explained above, according to the present invention, at least one supply groove is provided on the contact surface where the drive shaft and the main bearing slide against each other, which communicates diagonally between the high-pressure side space and the area over the main bearing, and which, due to the rotation of the drive shaft, functions as a pump. Thus, the first oil passage, which passes though the high-pressure side space, the main bearing and the oil reservoir is formed, and the second oil passage, which passes through the high-pressure side space, the oil supply hole, the bottom space, the insertion hole, the low pressure side space and the compression space is formed by the pressure differential generated by sealing off the high-pressure side space from the low pressure side space with the seal bearing. As a result, lubricating oil can be supplied separately to the main bearing and to the thrust bearing and the insertion hole, achieving efficient lubrication.

Also, according to the present invention, with the seal washer, the surface of which is polished to a specific roughness, being provided between the seal bearing and the drive shaft, the number of work steps required at the time of forming the drive shaft and the seal bearing can be reduced.

Furthermore, according to the present invention, by providing the elastic member between the seal bearing and the block, a minute gap, caused by the torsion of the drive shaft which is in turn caused by the force applied by the oscillating scroll member, is prevented from occurring at the seal bearing area, making it possible to supply lubricating oil stably.

Also, in order to achieve the other object of the present invention, the seal bearing 45 is formed in a ring-like shape of, for example, a sintered alloy, synthetic resin or ceramic material as shown in FIGS. 8A, 8B, 8C and 8D and the circular groove 45*a* is formed circularly near through hole 45*e* that is in contact with the bearing mounting section 20 and a plurality of radial grooves 45*b* that communicate between the circular groove 45*a* and the external circumferential side surface are formed on the sliding surface 45, which is located on the side facing the drive shaft. On the surface of the seal bearing 45 facing the block side, a circular notch 45*f* is formed for mounting the elastic member 70. Additionally, a press escape 45*d* is formed in the area 45*g* which is not in contact with the block 17. This press escape 45*d* is formed, as mentioned above, in the area 45*g* that is not in contact with the block 17 and at a position which faces opposite the radial grooves 45*b* in the form of an arc, to correspond to the shape of the radial grooves 45*b*.

Figure 9A:
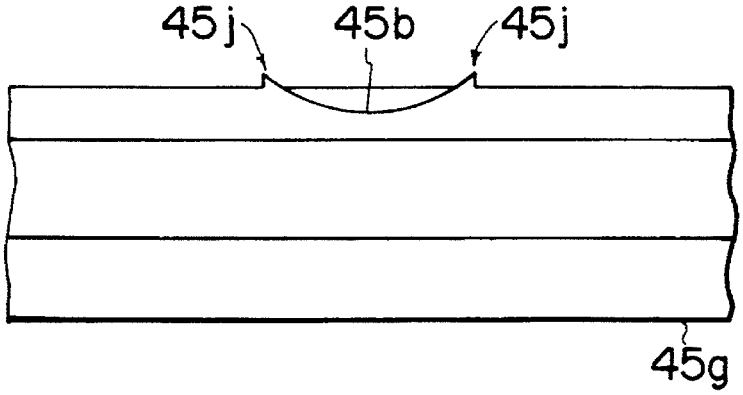
FIG. 9A illustrates a case in which a radial groove is formed by milling.
Figure 9B:
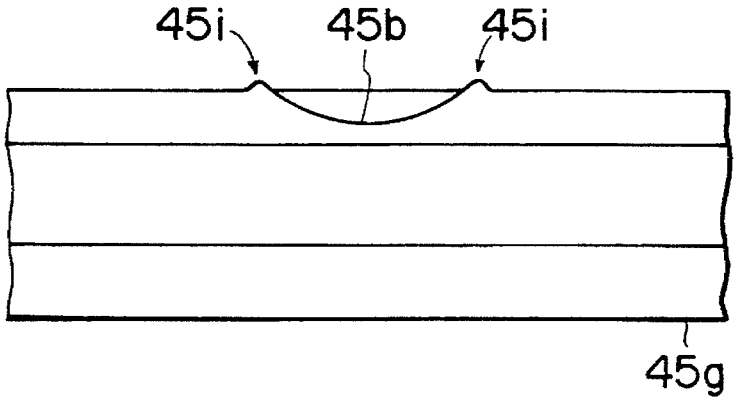
FIG. 9B illustrates a case in which press machining is performed without providing press escapes and FIG. 9C illustrates a case in which press machining is performed with press escapes.

The circular groove 45*a* and the radial grooves 45*b*, especially the latter, of the seal bearing 45 are, in the prior art, formed by milling. However, if grooves are formed by milling, the work required is considerable. Moreover, at the end of each radial groove 45*b* as shown in FIG. 9A, a burr 45*j* is formed. In order to flatten this burr 45*j*, further polishing is necessary, thereby increasing the number of work steps required. Also, when mass producing them by press machining, a protrusion 45*i* is formed at the end of the groove as shown in FIG. 9B and, just as in the previous case, it is necessary to add a machining step to flatten this protrusion by polishing or the like, thus increasing the number of work steps.

Figure 9C:
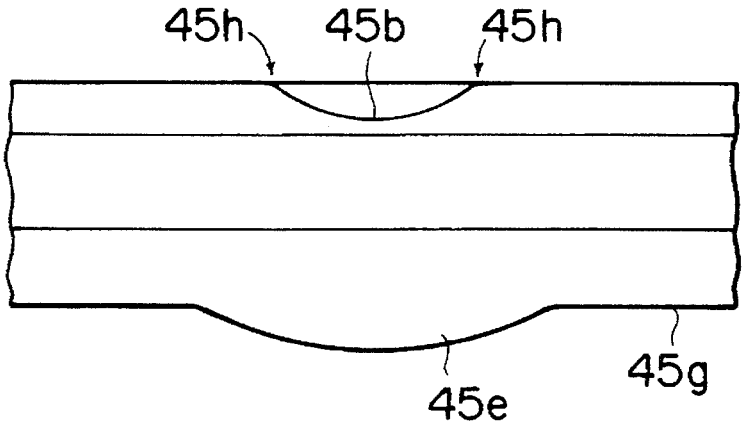

If the burr 45*j* or the protrusion 45*i* is left unprocessed, the quality of sealing at the seal bearing 45 deteriorates and also, the oil becomes heated due to the friction, causing the discharge performance to be reduced since the weight of the coolant taken in becomes reduced due to the expansion of the coolant. To deal with this, the press escape 45*e* is formed on the side surface of the seal bearing 45, in the area 45*g* on the block side where it is not in contact with the block 17, as shown in FIG. 9C, to prevent the protrusions 45*i* from occurring even though sag 45*h* occurs at the ends of the radial grooves 45*b*, achieving a seal bearing 45 with good flatness (good sealing characteristics).

Also, in the present embodiment, the circular seal washer 60, the surface of which is polished to a specific roughness, is provided between the seal bearing 45 and the end of the drive shaft 10 to eliminate the problem of finishing the surface of the end of the drive shaft 10 to a specific roughness. Furthermore, by providing the elastic member 70 between the seal bearing 45 and the support flange 17*a* of the block 17, the inclination of the drive shaft 10 which is caused by the force applied to the drive shaft 10 by the oscillating scroll member 28 is absorbed to improve the sealing characteristics of the seal bearing 45.

High-pressure lubricating oil is supplied from the high-pressure side space 46 to the circular groove 45*a* and the radial grooves 45*b* of the seal bearing 45 and this lubricating oil applies an upward force to the drive shaft 10. With this, the axial pressure applied in the direction of the shaft by the weight of the drive shaft 10 itself and the high pressure space 43 in the upper region can be reduced, and consequently the force applied to the oscillating scroll member 28 by the drive shaft 10 is also reduced. As a result, the force with which the end of the oscillating scroll 28*b* is in contact with the bottom surface of the fixed scroll 35*a* of the fixed scroll member 35 is reduced, and seizure is thereby prevented.

Therefore, according to the present invention, by forming the grooves on the seal bearing with press machining, by providing press escapes in the area where it does not slide against the block on the opposite side of the grooves at a position that corresponds with the grooves and in a form that corresponds to the grooves, protrusions at the ends of the grooves can be prevented and it thus becomes possible to produce seal bearings with press machining in larger quantities at lower cost without diminishing their sealing characteristics.

What is claimed is

1. A scroll compressor comprising:

a sealed case having an upper end and a lower end and having an intake port and an outlet port;

an electric motor mounted in said sealed case;

a drive shaft operably coupled to said electric motor, said drive shaft having a top end and a bottom end;

a bearing mounting section extending downwardly from said bottom end of said drive shaft;

an oscillating shaft extending axially downwardly from a bottom end of said bearing mounting section and being mounted eccentrically with respect to a rotational axis of said drive shaft;

an oscillating scroll member having an upwardly opening insertion hole formed therein, said oscillating shaft being rotatably mounted in said insertion hole such that a bottom space is formed between said oscillating scroll member and a bottom end of said oscillating shaft;

a block secured in said sealed case and having a through hole therein, said drive shaft being rotatably mounted in said through hole;

a main bearing mounted in said through hole and about said drive shaft so as to be interposed between said drive shaft and said block;

a fixed scroll member engaged with said oscillating scroll member such that said fixed scroll member and said oscillating scroll member together form a compressor unit;

a seal bearing mounted about said bearing mounting section and between said block and said bottom end of said drive shaft so as to bear against said bottom end of said drive shaft;

wherein an oil reservoir is formed above said block;

wherein an oil space, disposed below said main bearing, is defined by said drive shaft and said block between said main bearing and said seal bearing, said oil space being in communication with said oil reservoir;

wherein an oil supply hole is formed through said drive shaft and said oscillating shaft and communicates between said oil space and said bottom space; and wherein at least one oil supply groove is formed between an external circumferential surface of said drive shaft and an inner bearing surface of said main bearing, said at least one oil supply groove being inclined relative to the rotational axis of said drive shaft and communicating between an upper end and a lower end of said main bearing.

2. A scroll compressor as recited in claim 1, wherein a seal washer, having a polished surface, is provided between said seal bearing and said bottom end of said drive shaft.

3. A scroll compressor as recited in claim 1, wherein an elastic member is provided between said seal bearing and said block.

4. A scroll compressor as recited in claim 1, wherein said seal bearing has a circular groove formed in a top side surface thereof, and radial grooves communicating between said circular groove and said oil space.

5. A scroll compressor as recited in claim 4, wherein a seal washer, having a polished surface, is provided between said seal bearing and said bottom end of said drive shaft.

6. A scroll compressor as recited in claim 4, wherein an elastic member is provided between said seal bearing and said block.

7. A scroll compressor as recited in claim 4, wherein said seal bearing is provided, on a side thereof opposite said radial grooves, with press escapes aligned with said radial grooves, respectively, and in an area of said seal bearing which is not in contact with said block.

8. A scroll compressor as recited in claim 7, wherein each of said press escapes are formed with an arc shape.

9. A scroll compressor comprising:

a sealed case;

a drive unit provided in a high pressure space within said sealed case, said drive unit including a motor and a drive shaft operably connected to said motor;

an oscillating shaft eccentrically mounted to and extending from an end of the drive shaft;

an oscillating scroll member mounted in said sealed case and being provided with an insertion hole in which said oscillating shaft is rotatably mounted;

a block secured within said sealed case and being provided with a through hole in which said drive shaft is rotatably accommodated;

a main bearing interposed between said block and said drive shaft;

a fixed scroll member mounted in said sealed case and which engages with said oscillating scroll member in such a manner that said oscillating scroll member is freely oscillatable, a compression space being formed between said fixed scroll member and said oscillating scroll member;

an oil reservoir formed within said high pressure space for storing lubricating oil;

a low-pressure side space formed between said block and said oscillating scroll member;

a high-pressure side communicating with said oil reservoir and space formed between said block and the end of said drive shaft;

a seal bearing that seals off the high-pressure side space from the low-pressure side space;

at least one oil supply groove formed on an external circumferential side surface of said drive shaft, one end of said at least one oil supply groove opening into said high-pressure side space and the other end of said at least one oil supply groove opening above said main bearing;

a bottom space formed between said oscillating scroll member and an end of said oscillating shaft;

an oil supply hole that communicates between said high-pressure side space and said bottom space; and wherein said seal bearing is provided with radial grooves, one end of each of which communicates with said high-pressure side space, and a circular groove which communicates with the other end of each of said radial grooves on a side surface of said seal bearing facing the lower end of said drive shaft.

10. A scroll type compressor according to claim 9, wherein:

a seal washer, the surface of which is polished to a specific surface roughness, is provided between said seal bearing and said drive shaft.

11. A scroll type compressor according to claim 9, wherein:

an elastic member is provided between said seal bearing and said block.

12. A scroll type compressor according to claim 9, wherein:

said seal bearing is provided, on a side thereof opposite said radial grooves, with press escapes aligned with said radial grooves, respectively, and in an area of said seal bearing which is not in contact with said block.

13. A scroll type compressor according to claim 12, wherein:

each of said press escapes is formed in an arc shape.

14. A scroll compressor comprising:

a sealed case;

a drive unit provided in a high pressure space within said sealed case, said drive unit including a motor and a drive shaft operably connected to said motor;

an oscillating shaft eccentrically mounted to and extending from an end of the drive shaft;

an oscillating scroll member mounted in said sealed case and being provided with an insertion hole in which said oscillating shaft is rotatably mounted;

a block secured within said sealed case and being provided with a through hole in which said drive shaft is rotatably accommodated;

a main bearing interposed between said block and said drive shaft;

a fixed scroll member mounted in said sealed case and which engages with said oscillating scroll member in such a manner that said oscillating scroll member is freely oscillatable, a compression space being formed between said fixed scroll member and said oscillating scroll member;

an oil reservoir formed within said high pressure space for storing lubricating oil;

a lower-pressure side space formed between said block and said oscillating scroll member;

a high-pressure side space communicating with said oil reservoir and formed between said block and the end of said drive shaft;

a seal bearing that seals off the high-pressure side space from the low-pressure side space;

at least one oil supply groove formed on an external circumferential side surface of said drive shaft, one end of said at least one oil supply groove opening into said high-pressure side space and the other end of said at least one oil supply groove opening above said main bearing;

a bottom space formed between said oscillating scroll member and an end of said oscillating shaft;

an oil supply hole that communicates between said high-pressure side space and said bottom space; and wherein a seal washer, the surface of which is polished to a specific surface roughness, is provided between said seal bearing and said drive shaft.

15. A scroll compressor comprising:

a sealed case;

a drive unit provided in a high pressure space within said sealed case, said drive unit including a motor and a drive shaft operably connected to said motor;

an oscillating shaft eccentrically mounted to and extending from an end of the drive shaft;

an oscillating scroll member mounted in said sealed case and being provided with an insertion hole in which said oscillating shaft is rotatably mounted;

a block secured within said sealed case and being provided with a through hole in which said drive shaft is rotatably accommodated;

a main bearing interposed between said block and said drive shaft;

a fixed scroll member mounted in said sealed case and which engages with said oscillating scroll member in such a manner that said oscillating scroll member is freely oscillatable, a compression space being formed between said fixed scroll member and said oscillating scroll member;

an oil reservoir formed within said high pressure space for storing lubricating oil;

a lower-pressure side space formed between said block and said oscillating scroll member;

a high-pressure side space communicating with said oil reservoir and formed between said block and the end of said drive shaft;

a seal bearing that seals off the high-pressure side space from the low-pressure side space;

at least one oil supply groove formed on an external circumferential side surface of said drive shaft, one end of said at least one oil supply groove opening into said high-pressure side space and the other end of said at least one oil supply groove opening above said main bearing;

a bottom space formed between said oscillating scroll member and an end of said oscillating shaft;

an oil supply hole that communicates between said high-pressure side space and said bottom space; and an elastic member provided between said seal bearing and said block.

* * * * *